US009497835B2

(12) United States Patent
Koch et al.

(10) Patent No.: US 9,497,835 B2
(45) Date of Patent: Nov. 15, 2016

(54) METHOD FOR THE RELATIVE ACTIVATION OF A LUMINAIRE, CONTROL UNIT AND LIGHTING SYSTEM

(71) Applicant: TRIDONIC GmbH & Co KG, Dornbim (AT)

(72) Inventors: Patrik Yves Koch, Langenargen (DE); Stefan Sohm, Dornbirn (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 20 days.

(21) Appl. No.: 14/389,833

(22) PCT Filed: Apr. 4, 2013

(86) PCT No.: PCT/AT2013/000058

§ 371 (c)(1),
(2) Date: Feb. 5, 2015

(87) PCT Pub. No.: WO2013/149277

PCT Pub. Date: Oct. 10, 2013

(65) Prior Publication Data

US 2016/0029462 A1 Jan. 28, 2016

(30) Foreign Application Priority Data

Apr. 5, 2012 (DE) ..... 10 2012 007 017

(51) Int. Cl.
*H05B 37/02* (2006.01)
*G08C 19/28* (2006.01)

(52) U.S. Cl.
CPC ..... *H05B 37/0254* (2013.01); *H05B 37/0281* (2013.01)

(58) Field of Classification Search
CPC ..... H05B 37/0254; H05B 37/0281
USPC ..... 315/307, 136, 292
See application file for complete search history.

(56) References Cited

U.S. PATENT DOCUMENTS 5,962,992 A * 10/1999 Huang ..... H04L 12/2816 315/294
6,459,938 B1 10/2002 Ito et al.

FOREIGN PATENT DOCUMENTS

CH 682022 A5 6/1993
CN 101132664 A 2/2008
(Continued)

OTHER PUBLICATIONS

Schimid et al., WO1992022048A1 Machine Translation, Dec. 10, 1992, pp. 1-11.*

(Continued)

*Primary Examiner* — Daniel D Chang
(74) *Attorney, Agent, or Firm* — Volpe and Koenig, P.C.

(57) ABSTRACT

For the relative activation of a luminaire, actuation of an actuating element, particularly of a pushbutton, is detected. During actuation of the actuating element, the following steps are performed cyclically: ascertainment of a target control point (P_1, P_2) that corresponds to one of a plurality of sampling points (61, 62) encountered sequentially during the actuation; generation of a control command (71, 72) on the basis of the target control point (P_1, P_2); and issuing of the control command (71, 72) in order to reach a sampling point (61, 62) corresponding to the target control point (P_1, P_2) at a predefined change-over time (68). During continued actuation of the actuating element, a predefined period of time (68) is allowed to pass after a control command (71) is issued before a further control command (72) is issued in order to reach another sampling point (62) that corresponds to a further target control point (P_2).

12 Claims, 4 Drawing Sheets

(56) References Cited

FOREIGN PATENT DOCUMENTS

| | | | | | |
|---|---|---|---|---|---|
| DE | 102006001256 | A1 | | 7/2007 | |
| TW | 201110826 | A1 | | 3/2011 | |
| WO | 9222048 | A1 | | 12/1992 | |
| WO | WO 9222048 | A1 | * | 12/1992 | ..... G08C 19/28 |
| WO | 9960804 | A1 | | 11/1999 | |
| WO | 2010048987 | A1 | | 5/2010 | |

OTHER PUBLICATIONS

"ABB i-bus KNX Application Handbook Lighting" 2010 ABB STOTZ-KONTAKT GmbH [downloaded on Aug. 26, 2013) Downloaded from: <URL: http://www.knxgebaeudesysterne.de/st o_g/Deutsch/Oesterreich_Schweiz/ABB_ibus_KNX/Applikationen/2CDC500051M0102_ApplikationsHB_Beleuchtung.pdf >.

* cited by examiner

METHOD FOR THE RELATIVE ACTIVATION OF A LUMINAIRE, CONTROL UNIT AND LIGHTING SYSTEM

FIELD OF THE INVENTION

The invention relates to a method for the relative activation of a luminaire, to a controller for the relative activation of a luminaire and to a lighting system.

BACKGROUND

For convenient lighting control, lighting systems of relatively modern design allow control commands for controlling luminaires to be transmitted to the luminaires or to the operating devices thereof. By way of example, such operating devices for luminaires may be designed to receive control commands produced on the basis of the DALI ("Digital Addressable Lighting Interface") standard and to implement them for the control of the relevant luminaire. Such systems also allow complex control processes for a lighting system having a plurality of luminaires to be performed under the control of a controller. By way of example, the intensity and/or color and/or color temperature of one or more luminaires can be controlled.

In principle, control can be affected in two different ways. In the case of "absolute" activation or "absolute" actuation, an absolute actuation value that a luminaire is intended to adopt at the end of the process is already certain when the process is initiated and a control command is output to the luminaire. An exemplary scenario is the selection of one of a plurality of prescribed moods of a lighting system, wherein the intensity and color temperature associated with a luminaire are stipulated and a corresponding control command can be generated as soon as the relevant mood is selected. For the absolute activation, the luminaire can be provided with the absolute actuation value as a target. The output of light from the luminaire can be set in accordance with the absolute actuation value, for example in a changeover process.

In the case of "relative" activation or "relative" actuation, the absolute actuation value that the luminaire is meant to adopt at the end of the process is not yet certain at the beginning of the process. Rather, a current actuation value of a manipulated variable of the luminaire needs to be increased or decreased by one or more increments so long as a pushbutton switch is pushed, for example. An exemplary scenario is the adjustment of the intensity during dimming, which can take place in response to the operation of a pushbutton switch for example. In the case of "relative" activation or "relative" actuation, a final value is not yet certain at the beginning of the process. Even the duration of the process is unknown when the process begins. A conventional implementation for the control of luminaires in the case of "relative" activation or "relative" actuation involves the same control command being repeated continually for as long as the process lasts. In this way, by repeatedly outputting the same "UP" or "DOWN" command on the basis of the DALI standard for example, it is possible to achieve an incremental increase or decrease in an actuation value of a luminaire. This approach can result in a relatively high utilization level for a bus system, however. This can make it difficult to execute other commands in a reasonable time.

WO 99/60804 A1 describes information systems in which light control can take place via a network. The operation of a switch allows a light intensity to be increased or decreased, with an appropriate command being produced in each case in response to single operation of a switch. In the event of multiple operation of the switch, a plurality of commands are accordingly produced. A dimming rate can be programmed variably via the network.

DE 10 2006 001 256 A1 describes a method for operating a light source and a lamp operating device in which the lamp operating device receives brightness commands and ascertains a dimming period automatically.

SUMMARY

It is an object of the invention to specify a method, a controller and a lighting system that allow efficient relative activation. The invention is based particularly on the object of specifying a method for the relative activation of a luminaire, a controller for the relative activation of a luminaire, and a lighting system in which it is not necessary for the very same command to be produced at very short intervals in order to achieve relative activation.

The object is achieved by a method, a controller and a lighting system having the features specified in the independent patent claims. The dependent patent claims define embodiments of the invention.

According to one aspect, a method for the relative activation of a luminaire is specified. Operation of an operating element is sensed. While the operating element is being operated, the following steps are cyclically executed: ascertainment of a target actuation value that corresponds to one of a plurality of interpolation points that are sequentially approached during the operation; production of an actuation command on the basis of the target actuation value; and output of the actuation command in order to approach an interpolation point that corresponds to the target actuation value with a prescribed changeover time. While the operating element is continuing to be operated a prescribed period of time is waited after the output of an actuation command before a further actuation command is output in order to approach a further interpolation point that corresponds to a further target actuation value.

The method involves actuation commands being cyclically produced and output while an operating element is operated, with successive actuation commands being output in each case only at intervals of time that correspond to the prescribed period of time. Interpolation-point-based control is affected, in which a plurality of interpolation points that are each associated with a target actuation value specified in a control command are sequentially approached with the luminaire. This allows the number of actuation commands to be transmitted to be kept relatively low.

The manipulated variable that is set using the method can comprise an intensity. In this case, the different target actuation values that are ascertained in succession can correspond to different brightness values or intensities of the luminaire. The manipulated variable that is set using the method can comprise a color temperature or a color. In this case, the different target actuation values that are ascertained in succession can correspond to different color temperatures or colors of the luminaire.

The operating element may be a pushbutton switch. The pushbutton switch may be integrated in a control panel, which may be embodied as a touch-sensitive control panel, for example. The target actuation values can each be ascertained on the basis of whether the pushbutton switch is operated such that an increase in a manipulated variable is meant to be achieved, or whether the pushbutton switch is operated such that a decrease in the manipulated variable is meant to be achieved.

The target actuation value can be ascertained in each case on the basis of the prescribed changeover time. The target actuation value can be ascertained in each case on the basis of an initial actuation value that the manipulated variable has at the beginning of the operation of the operating element.

In response to an end of the operation of the operating element it is possible for a stop command to be produced and output in order to terminate a changeover process. The stop command does not need to contain a new target actuation value. The stop command can suppress undesirable continuation of a changeover process to the actuation value that the last actuation command contains when the end of the operation of the operating element is sensed.

In response to the end of the operation it is possible for a final actuation value to be ascertained. A correction actuation command can be produced and output on the basis of the final actuation value. The final actuation value can be ascertained by a controller arithmetically and on the basis of a duration of the operation of the operating element. This allows a small correction to the actuation value to be made following the output of the stop command. By way of example, this makes it possible to compensate for delays in the execution of actuation commands and/or the stop command that may occur in the operating device of a lamp.

The stop command can be output before the prescribed period of time after the output of that actuation command that was produced most recently before the end of the operation of the operating element has elapsed. Hence, for the output of the stop command, it is not necessary to wait until the prescribed period of time has elapsed again. The stop command can be produced and output immediately after the end of the operation of the operating element.

The prescribed period of time after which a new actuation command is output in each case may be equal to the prescribed changeover time or less than the prescribed changeover time.

While the operating element is continuing to be operated a new actuation command can be periodically produced in each case when the prescribed changeover time elapses or before the prescribed changeover time elapses. As a result, a new actuation command with a new target actuation value can be produced and output precisely when the manipulated variable of the luminaire reaches a target actuation value that the most recently output actuation command contains. Alternatively, a new actuation command with a new target actuation value can be produced and output shortly before the instant at which the manipulated variable of the luminaire reaches a target actuation value that the most recently output actuation command contains.

An input signal that indicates a state of the operating element can be evaluated at a rate that is greater than the inverse of the prescribed period of time. The state of the operating element can therefore be polled at intervals of time that are short in comparison with the prescribed period of time after which a new actuation command is output. This allows a rapid response to a change in the state of the operating element.

For the respective activation process that takes place while the operating element is continuing to be operated, adjacent interpolation points from the plurality of interpolation points may each have the same actuation value difference. For the respective activation process that takes place while the operating element is continuing to be operated, the prescribed changeover time may have a fixed value that is not altered while the operating element is continuing to be operated. If new relative activation takes place at a later instant after the operation of the operating element has been temporarily interrupted, a different actuation value difference between adjacent interpolation points and/or a different changeover time can be stipulated for the new relative activation process.

At the beginning of the operation of the operating element a first actuation command can be produced that comprises the prescribed changeover time and a target actuation value.

The actuation command can be transmitted to an operating device of the luminaire. The operating device can approach the target actuation value continuously or in multiple stages in the prescribed changeover time in response to the actuation command.

The actuation command may be an actuation command based on the DALI standard. The actuation command may comprise a DALI short address for the luminaire. The actuation command can be output to a bus, particularly a DALI bus.

According to a further aspect, a controller for the relative activation of a luminaire is specified. The controller comprises a signal input for receiving an input signal that indicates a state of an operating element. The controller comprises an interface for outputting commands. The controller comprises a control logic unit that is coupled to the signal input and to the interface and is set up in order to take the input signal as a basis for determining whether the operating element has been operated. The control logic unit is set up in order, while the operating element is being operated, to ascertain a target actuation value that corresponds to one of a plurality of interpolation points, to produce an actuation command on the basis of the target actuation value, and to output the actuation command via the interface in order to approach an interpolation point that corresponds to the target actuation value with a prescribed changeover time. The control logic unit is set up such that, while the operating element is continuing to be operated, a prescribed period of time is waited after the output of the actuation command before the output of a further actuation command to approach a further interpolation point that corresponds to a further target actuation value.

Developments of the controller and the effects respectively attained thereby correspond to the developments of the method according to exemplary embodiments. The controller may be set up to perform the method according to one aspect or exemplary embodiment.

According to a further aspect, a lighting system is specified. The lighting system comprises an operating element that prompts relative activation or operation of the luminaire. The lighting system comprises a controller according to one aspect or exemplary embodiment of the invention, the signal input of which is set up to receive an input signal that indicates a state of the operating element. The lighting system comprises an operating device for a lamp, wherein the operating device comprises a control device that is set up in order to approach the target actuation value with the prescribed changeover time in response to the actuation command.

The controller and the operating device for the luminaire may be coupled via a bus.

The operating element may be a pushbutton switch or comprise a pushbutton switch. The pushbutton switch may be integrated in a control panel, which may be embodied as a touch-sensitive control panel, for example. The target actuation values can be ascertained in each case on the basis of whether the pushbutton switch is operated such that an increase in a manipulated variable is meant to be achieved, or whether the pushbutton switch is operated such that a decrease in the manipulated variable is meant to be achieved. The pushbutton switch may be a changeover pushbutton switch.

The operating element may comprise a sensor, for example a light sensor. Operating of the light sensor is identified on the basis of a threshold value comparison of the brightness sensed by means of the light sensor.

The control logic unit of the controller may be set up in order to produce and output a stop command in response to an end of the operation of the operating element. The control device of the operating device may be set up in order to terminate an approach to an interpolation point that corresponds to a target actuation value ascertained most recently before the end of the operation in response to the stop command.

Exemplary embodiments can be used generally for relative actuation in lighting systems, for example for dimming.

BRIEF DESCRIPTION OF THE DRAWINGS

Further features, effects and functions of exemplary embodiments of the invention will become evident from the detailed description below with reference to the appended drawings.

DETAILED DESCRIPTION OF THE PREFERRED EMBODIMENTS

In the figures, identical or similar reference symbols denote identical or similar units or components. The features of various exemplary embodiments can be combined with one another if this is not expressly precluded in the description that follows. While some exemplary embodiments for relative activation are described within the context of intensity or brightness control, the exemplary embodiments of the invention are not limited thereto but rather can be used generally for the relative activation of a luminaire.

Figure 1:
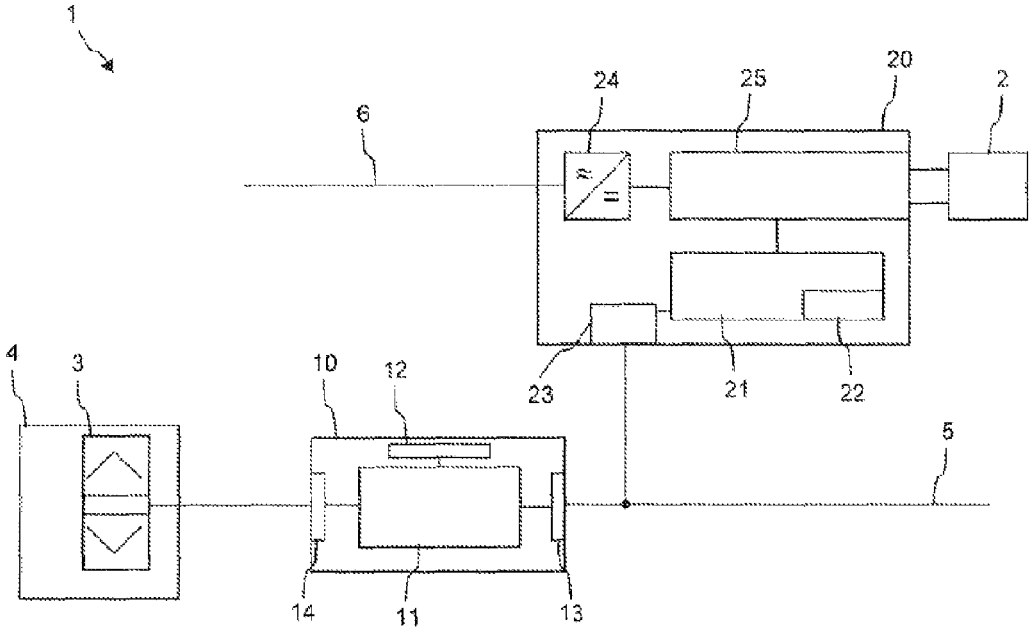
FIG. 1 shows a lighting system according to an exemplary embodiment.

FIG. 1 shows a lighting system 1 with a controller 10 according to an exemplary embodiment of the invention. The lighting system 1 comprises a luminaire with an illuminant 2. By way of example, the illuminant 2 may be a gas discharge lamp or an LED-based luminaire. The lighting system 1 may comprise further luminaires, each of which has an associated explicit address in order to allow control commands to be addressed by the controller 10. The lighting system 1 comprises an operating device 20 for the illuminant 2.

The operating device 20 may be embodied as a ballast. The operating device 20 is operated on the basis of control commands that the operating device 20 receives from the controller 10. The operating device 20 has an interface 23 via which data communication with the controller 10 takes place. The data communication can be effected by wire, for example via a bus 5, or wirelessly. The data communication may be digital data communication. The bus 5 may be a DALI bus, and commands can be produced on the basis of the DALI standard. Further operating devices may be connected to the bus 5. Commands received from the interface 23 are processed by a control device 21 that controls the operating of the operating device 20 on the basis of the received command.

The operating device 20 may be embodied such that it allows intensity control and/or color control for the luminaire. The operating device 20 is supplied with power via a supply line or supply lines 6. The operating device 20 has a circuit in order to supply the illuminant 2 with power, the embodiment of said circuit being dependent on the functionalities that the operating device 20 provides for controlling the luminaire. By way of example, the operating device 20 may comprise a rectifier 24 and a circuit 25 connected downstream thereof. If the operating device 20 allows intensity control of the luminaire, the circuit 25 may have an intermediate circuit, an inverter and an output-side load circuit, for example. In the case of such an embodiment, the intermediate circuit can produce an intermediate circuit voltage, for example, which is converted by the invertor into a high-frequency AC voltage that can in turn be supplied to the output-side load circuit, which has output connections for the illuminant 2. By way of example, the brightness of the luminaire can then be altered by virtue of the frequency of the AC voltage generated by the invertor being altered. The control device 21 integrated in the operating device 20 controls the circuit 25 on the basis of a received control command in order to implement the control command. As a result, brightness control may involve the control device 21, for example, adjusting the power converted by the illuminant 2 such that it is ultimately operated at the new desired brightness. The transition from the initial brightness to the new final brightness can take place continuously or in relatively small stages in this case in order to bring about a more agreeable brightness transition. Other embodiments of the operating device 20 can be used depending on the type of illuminant 2 and/or depending on the control options that the operating device 20 provides. By way of example, the control device 21 can control the circuit 25 of the operating device 20 such that color control is possible.

The controller 10 of the lighting system 1 is embodied such that it produces control commands and outputs them to the operating device 20 of the luminaire. As described in detail below, the controller 10 is set up such that, for the purpose of relative activation of the luminaire, while an operating element is continuing to be operated, it cyclically ascertains a respective new target actuation value for a manipulated variable of the luminaire, produces an actuation command on the basis of the target actuation value and outputs the actuation command to the operating device 20 of the luminaire. The processes are repeated cyclically, and a new actuation command for the relative actuation of the luminaire is not output between successive actuation commands during a prescribed period of time. In this case, the respective ascertained target actuation values are in each case only the intermediate values that the manipulated variable of the luminaire is meant to assume after a prescribed changeover time, not the final value of the manipulated variable at the end of the relative activation. This final value is not yet known while the target actuation values are cyclically ascertained and corresponding actuation commands are produced and output. Similarly, the length of the time interval in which new actuation commands are cyclically produced at an interval of time is not known when the actuation process is initiated by virtue of the operating element being operated. The final value and the length of the time interval in which new actuation commands are cyclically produced at an interval of time are defined by the instant at which the operating element is released again by the user.

The relative activation of the luminaire takes place on an interpolation point basis. While the operating element is continuing to be operated, a plurality of interpolation points for the manipulated variable of the luminaire are sequentially approached that correspond to the various target actuation values ascertained in succession. The output of a new control command for the relative activation of the luminaire is performed in each case only after a prescribed period of time. The relative activation of the luminaire is therefore effected by data telegrams that are produced at a particular rate so long as the operating element is operated by a user. The relative activation according to exemplary embodiments is particularly suitable for the use of such data telegrams or is telegram-optimized.

In response to an actuation command that is produced by the controller 10 on the basis of a new target actuation value for the manipulated variable of the luminaire, the control device 21 of the operating device 20 controls the operating device 20 such that the actuation value of the manipulated variable is changed to the target actuation value in a prescribed changeover time continuously or in multiple stages. By way of example, the manipulated variable may be intensity or brightness, a color, a color temperature or the like.

The changeover time with which a new interpolation point is respectively approached by the operating device 20 may have a prescribed, invariable value during the relative activation. The value for the changeover time can be transmitted by the controller 10 in at least one of the actuation commands. The changeover time can be stored in a memory 22 of the control device 21 in the operating device 20 and used for all the changeover processes that are initiated by successive actuation commands from the controller 10 in order to successively approach a plurality of interpolation points that correspond to the different, successively ascertained target actuation values while the operating element is continuing to be operated.

The prescribed period of time after which the controller 10 outputs a new actuation command can be chosen on the basis of and in coordination with the prescribed changeover time. The prescribed period of time may be less than the prescribed changeover time. The prescribed period of time may be equal to the prescribed changeover time. This allows the controller 10 to output a new actuation command precisely when the target actuation value indicated in the most recently output actuation command has been approached with the changeover time. The controller 10 can ascertain the target actuation values that are respectively ascertained and approached by the operating device 20 while the operating element is continuing to be operated on the basis of the changeover time. The controller 10 can also ascertain the target actuation values on the basis of an initial actuation value of the luminaire that the manipulated variable has at the beginning of the relative activation.

As soon as the controller 10 identifies that the user is no longer operating the operating element, a stop command is produced and output. This aborts a changeover process to the most recently ascertained target actuation values as soon as the user releases the operating element. The controller 10 uses the stop command to abort the approach to an interpolation point that corresponds to the target actuation value ascertained most recently before the operating element is released. The stop command can be produced immediately, in particular, in response to the identified release of the operating element. The controller 10 can output the stop command before the prescribed period of time after the output of the most recently produced actuation command has elapsed.

Before the operation of the operating element is terminated, an actuation command for approaching an interpolation point has been output to the luminaire. The corresponding process in which the luminaire approaches the new interpolation point can continue to run when the operation of the operating element is terminated. The stop command aborts the changeover that is currently still running.

Optionally, a correction actuation command can be output after the stop command. To this end, the controller can take a period of time in which the operating element has been operated continuously as a basis for arithmetically ascertaining a final actuation value for the manipulated variable of the luminaire. The correction actuation command can be produced on the basis of the final actuation value. As a result, following the release of the operating element, for example, relatively small corrections to the actuating value of the manipulated variable can be made that can be caused by processing times for control commands in the operating device 20 and/or delays in the command output to the bus 5 by the controller 10.

The controller 10 is set up such that it senses the state of the operating element with a high degree of temporal resolution. The inverse of a rate at which the state of the operating element is checked may be small in comparison with the prescribed period of time that defines the interval of time between actuation commands. The inverse of the rate at which the state of the operating element is checked may be small in comparison with the prescribed changeover time with which new interpolation points are approached for the relative activation.

In order to perform the various processes described, the controller 10 has a control logic unit 11. The control logic unit 11 may comprise one or more processors or special circuits. The control logic unit 11 may be coupled to a memory 12 that may store, by way of example, the actual value of the manipulated variable of the luminaire at the beginning of operating of the operating element. The control logic unit 11 is coupled to an interface 13 via which commands that are produced are output. The interface 13 can be used to output particularly the actuation commands that are produced sequentially during continuous operation of the operating element, and the stop command that is produced at the end of operating of the operating element. The interface 13 may be a wired interface, which may be coupled to a DALI bus 5, for example. The interface 13 may also be embodied as a wireless interface for wireless communication with the operating device 20.

In order to sense the state of the operating element, the controller 10 has a signal input 14. The signal input 14 is coupled to an operating element 3 in order to receive an input signal that indicates the state of the operating element 3. The operating element 3 may be embodied as a pushbutton switch. The pushbutton switch may be integrated in a control panel 4 that allows the control of a plurality of functions of the lighting system 1. The pushbutton switch does not need to have an element that is mounted so as to be able to tilt or that is mounted in another mobile manner, but rather may also be in the form of a section of a touch-sensitive control panel or in the form of a proximity sensor. The operating element 3 and/or the control panel 4 may be integrated in the controller 10. In further embodiments, the operating element 3 may comprise a sensor. A signal that indicates the state of the sensor can be provided at the signal input 14. The sensor may have an operated state that prompts the controller 10 to produce new actuation commands at intervals of time in order to prompt an approach to further interpolation points. By way of example, the sensor may be a light sensor. On the basis of a threshold value comparison of the sensed brightness, the sensor can have an "operated" state and prompt the output of actuation commands for approaching interpolation points at intervals of time. By way of example, relative activation based on interpolation points can be effected in order to increase a brightness when the brightness sensed by the light sensor is less than a first threshold value. Alternatively or in addition, relative activation based on interpolation points can be effected, for example, in order to decrease brightness when the brightness sensed by the light sensor is greater than a second threshold value. The operating element may alternatively or additionally comprise a proximity sensor.

The operating element 3 may be embodied such that it allows a manipulated variable to be set in different directions. For example, the operating element may have appropriate fields in order to increase or decrease the actuation value of a manipulated variable. At the signal input 14, the controller 10 receives an input signal that indicates the state of the operating element 3. By way of example, the input signal can indicate that the operating element is not being operated, that it is being operated to increase the actuation value of the manipulated variable or that it is being operated to decrease the actuation value of the manipulated variable. The operating element 3 may be embodied as a changeover pushbutton switch that can alternately increase or decrease the actuation value of a manipulated variable. The control logic unit 11 monitors the input signal with a high temporal resolution. To this end, the input signal can be polled and evaluated at a rate that is greater than the inverse of the prescribed changeover time and/or than the inverse of the prescribed period of time after which new actuation commands are output. This allows both the beginning and the end of the operation of the operating element 3 to be rapidly detected and an appropriate actuation command or a stop command to be produced.

Figure 2:
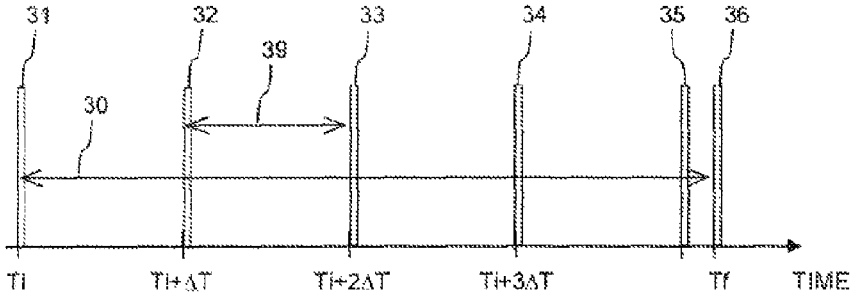
FIG. 2 schematically shows the production of a succession of control commands for the relative activation of a luminaire according to an exemplary embodiment.

FIG. 2 schematically shows a succession of commands that is output by the controller 10 for the relative activation of the luminaire when a user begins operation by pushing the operating element at a start time Ti, keeps the operating element pushed over a period 30 and releases the operating element at an end time Tf.

In response to the beginning of operation, a first actuation command 31 is produced that is output shortly after the beginning of operation at Ti. The first actuation command 31 is produced on the basis of a first target actuation value that is intended to be approached by the operating device 20 of the luminaire within a prescribed changeover time. The first target actuation value can be produced on the basis of an actual value of the manipulated variable of the luminaire at the start time Ti and on the basis of the prescribed changeover time. The first actuation command 31 may comprise the first target actuation value. The first actuation command 31 may also comprise the prescribed changeover time that is transmitted from the controller 10 to the operating device 20. The first actuation command 31 may comprise an address for the luminaire or for the operating device 20 associated with the illuminant 2. The address may be a DALI short address. In response to the first actuation command 31 the manipulated variable of the luminaire is set to the first target actuation value in the prescribed changeover time in multiple stages or continuously.

During the period 30 in which the user pushes the operating element continuously or the operating element is otherwise identified as activated, further target actuation values are cyclically ascertained and corresponding actuation commands produced and output. In this case, actuation commands that are used for the relative activation of the luminaire in response to the operation of the operating element are each output only after a prescribed period of time 39 so long as the operating element is being pushed. By way of example, a second actuation command 32, which is produced on the basis of a second target actuation value, is output a prescribed period of time ΔT later than the actuation command 31. A third actuation command 33, which is produced on the basis of a third target actuation value, is output a prescribed period of time ΔT later than the second actuation command 32. A fourth actuation command 34, which is produced on the basis of a fourth target actuation value, is output a prescribed period of time ΔT later than the third actuation command 33. A fifth actuation command 35, which is produced on the basis of a fifth target actuation value, is output a prescribed period of time ΔT later than the fourth actuation command 34. The delay in the output of actuation commands by in each case the prescribed period of time 39 means the data telegrams successively approach various interpolation points for which the manipulated variable of the luminaire adopts the first target actuation value, the second target actuation value, the third target actuation value and the fourth target actuation value. The second, third and fourth actuation commands may likewise each comprise the address of the luminaire or of the operating device 20 associated with the illuminant 2. The second, third and fourth actuation commands may each comprise the prescribed changeover time, but can also be produced such that the prescribed changeover time is not included again.

In response to the end of operation of the operating element at the end time Tf, a stop command 36 is immediately produced. The stop command 36 does not contain a new target actuation value, but rather prompts the operating device 20 to terminate the ongoing changeover process. For the succession of actuation commands that is shown in FIG. 2, this ongoing changeover process is the changeover process to the fifth target actuation value, which is prompted with the fifth actuation command 35. This process takes place when the stop command 36 is output. The operating device of the luminaire terminates the changeover to the fifth target actuation value in response to the stop command.

Figure 3:
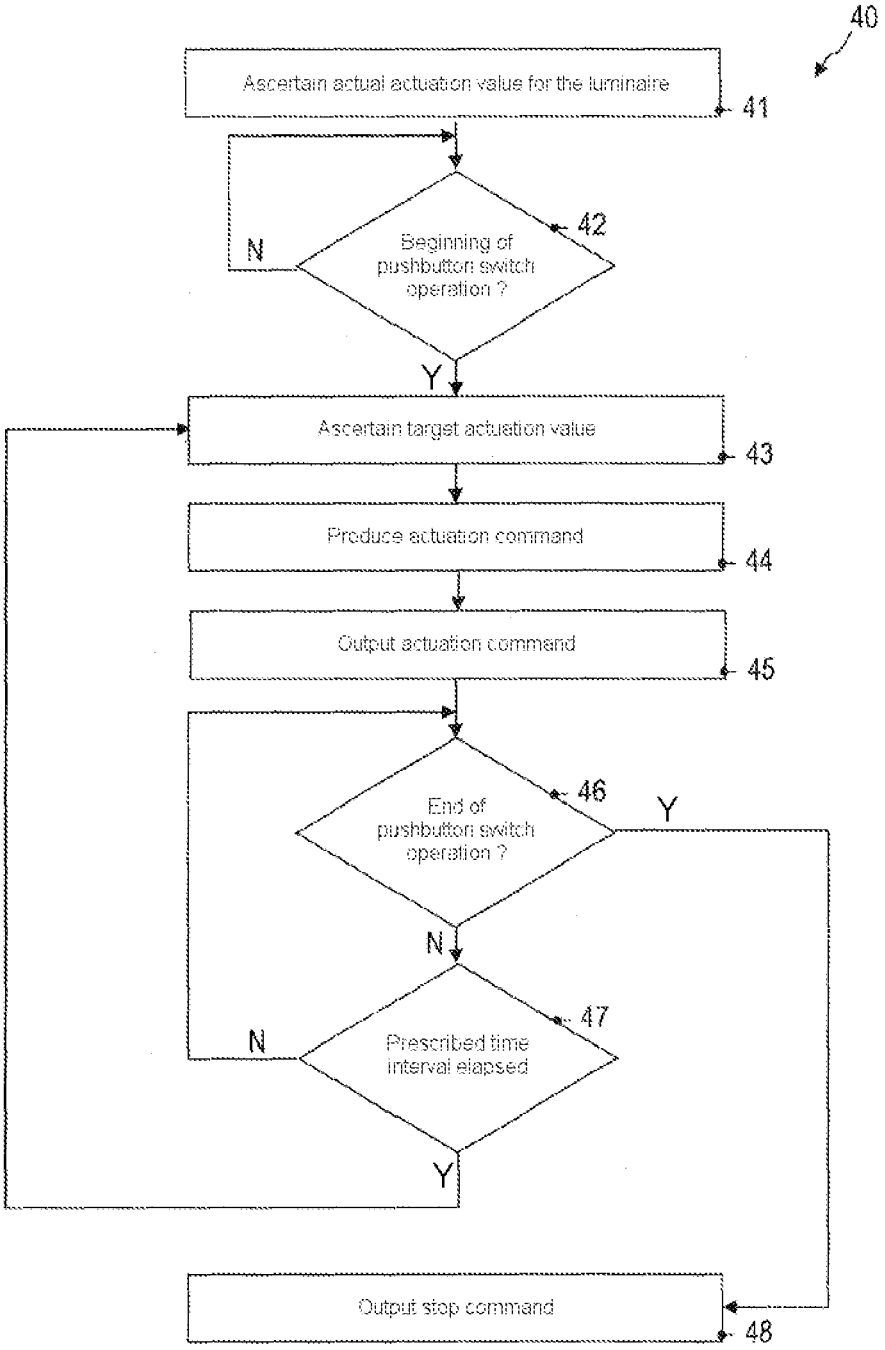
FIG. 3 shows a flowchart for a method according to an exemplary embodiment.

FIG. 3 shows a flowchart for a method 40 according to an exemplary embodiment. The method can be carried out automatically by the controller 10 in order to perform relative activation of a luminaire.

In step 41, the actual actuation value of the luminaire can be ascertained. The actual actuation value can be stored in a memory of the controller, for example, when a preceding control process has been terminated, and/or can be polled by the operating device of the luminaire. If the actual value is not intended to be polled by the operating device of the luminaire, the preceding activation can be followed by the sending of an absolute correction actuation value that is stored in the memory of the controller. For the relative control in the method 40, it can be assumed that the luminaire has adopted this correction actuation value. The absolute correction actuation value can be used as an arithmetic start value for the new relative activation.

Step 42 involves monitoring whether a pushbutton switch is operated. As soon as pushbutton switch operation is sensed, the method continues at 43. Otherwise, the monitoring of the pushbutton switch operation is continued in step 42.

The subsequent steps 43-45 are cyclically repeated for as long as the pushbutton switch operation lasts. In step 43, a target actuation value is ascertained. The target actuation value can be determined on the basis of a prescribed changeover time and on the basis of the actual actuation value of the luminaire that is ascertained at 41. The target actuation value can be chosen such that a desired actuation value difference, which may be dependent on the changeover time, relative to the actual actuation value is achieved. At 44, a control command is produced that is dependent on the target actuation value. The control command may comprise the target actuation value. At least when the first actuation command is produced after operation of the pushbutton switch has began; the first actuation command may comprise the prescribed changeover time. At 45, the actuation command is output. The actuation command can be output to a bus, for example a DALI bus.

In steps 46 and 47, a check is performed to determine whether steps 43-45 need to be executed again. In step 46, a check is performed to determine whether pushbutton switch operation has been terminated. An end of the pushbutton switch operation is also identified when the pushbutton switch allows setting in different directions and the user terminates a setting process in a first direction, for example increasing brightness, and begins a setting process in a second direction, for example decreasing brightness. As soon as an end of the pushbutton switch operation is identified, the cyclic repetition of steps 43-45 is terminated. The method continues in step 48, where a stop command is output in order to abort the ongoing changeover process.

If step 46 identifies that the operation of the pushbutton switch has not yet been terminated and the pushbutton switch continues to be operated, a check is performed in step 47 to determine whether the prescribed period of time since the last execution of steps 43-45 has elapsed, which is the waiting time between the output of actuation commands for the relative activation of the luminaire. If the prescribed period of time has not yet elapsed, the method returns to step 46.

If the prescribed period of time has elapsed since the last actuation command was produced and output, steps 43-45 are executed again. In this case, a further target actuation value is ascertained and a further actuation command is produced and output of on the basis of the further target actuation value. The further actuation value can be ascertained on the basis of the target actuation value ascertained in the preceding cycle and on the basis of the prescribed changeover time. The further target actuation value can be ascertained on the basis of a characteristic curve characterizing the behavior of the luminaire, for example a dimming curve. In this case, the target actuation value ascertained in the preceding cycle and the changeover time can be used in order to determine the new target actuation value on the basis of the characteristic curve that characterizes the behavior of the luminaire. The further target actuation value can be ascertained such that the same actuation value difference is again achieved relative to the target actuation value determined in the preceding cycle.

For the relative activation, steps 43-45 are cyclically repeated. The target actuation values respectively ascertained in step 43 do not in this case represent the final value of the manipulated variable at the end of the process that is controlled by the pushbutton switch operation. Instead, the target actuation values ascertained in step 43 are intermediate values that are sequentially approached while the pushbutton switch remains pushed. A target actuation value that is ascertained in step 43 therefore corresponds to an interpolation point that is intended to be approached when the luminaire is controlled. The target actuation value that is produced and output in the last cycle prior to termination of the pushbutton switch operation is no longer achieved by the luminaire in this case. The corresponding changeover process is aborted by the stop command that is output in step 48.

Figure 4:
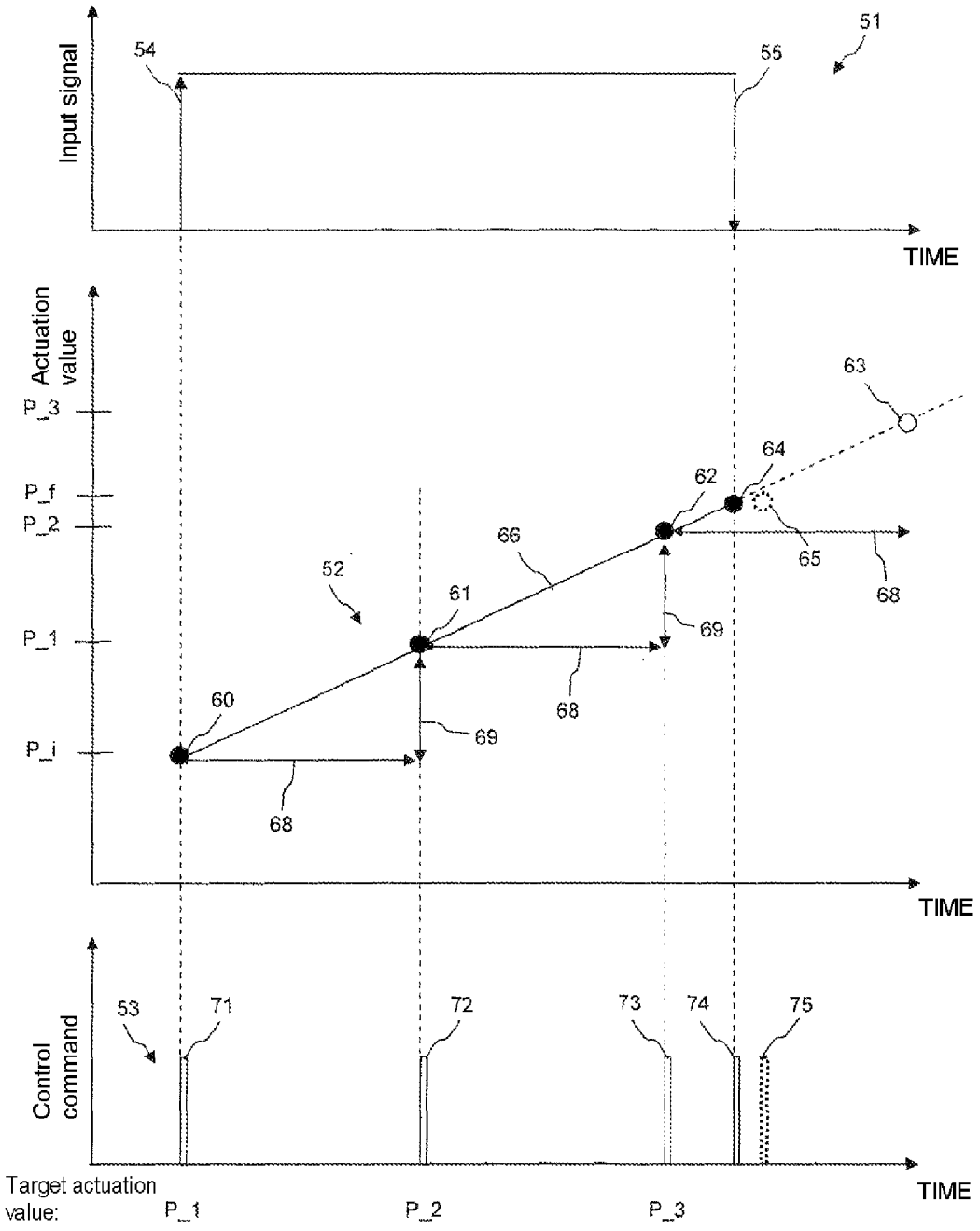
FIG. 4 shows a schematic illustration to explain methods according to exemplary embodiments.

FIG. 4 shows a schematic illustration to further explain the manner of operation of controllers and of methods according to exemplary embodiments.

A controller performs relative activation of a luminaire on the basis of an input signal for 51. The input signal 51 indicates operation of an operating element, for example a pushbutton switch. A first edge 54 of the input signal 51 indicates a beginning of the operation of the operating element, which lasts up until a second edge 55 of the input signal 51.

Alteration of a manipulated variable of the luminaire that is brought about by the controller in response to the operation of the operating element is shown in 52. When the operation of the operating element begins, the manipulated variable of the luminaire has an actual actuation value P_i that is the actuation value at the beginning of the process. A succession of control commands that are produced during the operation of the operating element approaches an interpolation point 61, at which the manipulated variable of the luminaire has a first target actuation value P_1 associated with the interpolation point 61, and a further interpolation point 62, at which the manipulated variable of the luminaire has a second target actuation value P_2 associated with the further interpolation point 62, in succession. In each case, a changeover process takes place in a prescribed changeover time 68. The changeover time 68, in which the luminaire is transferred from the initial state 60 to the first interpolation point 61, may be the same as the changeover time with which successive interpolation points are respectively approached.

An actuation value difference 69 between the first target actuation value P_1 and the actual actuation value P_i at the beginning of the process may be equal to an actuation value difference 69 between the second target actuation value P_2 and the first target actuation value P_1. Similarly, an actuation value difference between target actuation values that are output in successive actuation commands may be identical in each case. If the manipulated variable of the luminaire is able to assume only prescribed, discrete values in each case, the actuation value differences 69 may be determined such that they span a plurality of these values. The actuation value differences 69, which determine the respective ascertained target actuation values for each changeover process, can be ascertained by the controller on the basis of the changeover time 68.

As FIG. 4 illustrates, while the operating element is continuing to be operated continuously, respective changes to the manipulated variable by the same actuation value difference and in the same, prescribed changeover time can be made in order to activate further interpolation points. The changeover process, in which the manipulated variable is changed continuously or in multiple stages, can take place under the control of the operating device of the luminaire.

The succession of commands that is output by the controller that controls the plurality of changeover processes is shown at 53. A first actuation command 71 is produced when or shortly after the edge 54 of the input signal 51, which edge indicates the beginning of the operating of the operating element, is identified. The first actuation command 71 may contain the first target actuation value P_1. The first actuation command 71 may also contain the changeover time 68. In response to the first actuation command 71, the operating device of the luminaire changes the manipulated variable to the first target actuation value P_1, with a changeover process taking place with the changeover time 68.

When the changeover time 68 has elapsed, a second actuation command 72 is produced and output. The second actuation command 72 can therefore be produced when the manipulated variable of the luminaire has approached the first interpolation point 61, which corresponds to the first target actuation value P_1 that the preceding first actuation command 71 contains. The second actuation command 72 may contain the second target actuation value P_2. In response to the second actuation command 72, the operating device of the luminaire changes the manipulated variable to the second target actuation value P_2, with a changeover process taking place with the changeover time 68.

When the changeover time 68 has elapsed again, a third actuation command 73 is produced and output. The third actuation command 73 can therefore be produced when the manipulated variable of the luminaire has approached the second interpolation point 62, which corresponds to the second target actuation value P_2 that the preceding second actuation command 72 contains. The third actuation command 73 may contain a third target actuation value P_3. In response to the third actuation command 73, the operating device begins a fresh changeover process in order to alter the manipulated variable from the second target actuation value P_2 to the third target actuation value P_3.

In response to the end of operation of the operating element, which is identified as an edge 55 in the input signal 51, the stop command 74 is output. The stop command 74 does not need to contain a new target actuation value. In response to the stop command 74, the changeover process to the target actuation value P_3, which was ascertained most recently before the end of the operation of the operating element, is terminated. The manipulated variable has a final value P_f, as shown in 64. The luminaire is on, and the manipulated variable has the actuation value P_f.

The changeover time and the prescribed period of time after which a new actuation command is output in each case for as long as the operation of the operating element lasts may be the same, as shown schematically in FIG. 4. The changeover time and the prescribed period of time after which a new actuation command is output in each case for as long as the operation of the operating element lasts may each be longer than 1 second. The changeover time and the prescribed period of time after which a new actuation command is output in each case for as long as the operation of the operating element lasts may each be 1.4 seconds, for example. Such an interpolation point interval in the time domain gives good results in terms of flicker or response in the event of little data traffic on the bus.

The controller can optionally arithmetically calculate a final actuation value for the manipulated variable. By way of example, the final value can be ascertained on the basis of the duration of the time interval in which the operating element is continuously operated. The final actuation value can be ascertained on the basis of the actual actuation value of the luminaire at the beginning of the operation and on the basis of the duration of the time interval in which the operating element is continuously operated. The controller can output a correction actuation command 75 after the stop command 74, which correction actuation command contains the final actuation value or is produced otherwise on the basis of the final actuation value. In response to the correction actuation command 75, the operating device can set the manipulated variable to the final actuation value, so that a state that is shown schematically at 65 is reached. The luminaire is on, and the manipulated variable of the luminaire has the final actuation value ascertained arithmetically by the controller.

While FIG. 4 schematically shows an increase in an actuation value during relative activation, a decrease in the actuation value during relative activation can be implemented in corresponding fashion. Different pushbutton switch operations for an increase or decrease can be identified by the controller, with successive target actuation values that are identified while the pushbutton switch is operated being able to be selectively either increased or decreased by an actuation value difference.

The manipulated variable that is set in the process may be the brightness or intensity of the luminaire, for example. The target actuation values or the final activation value may be brightness values in this case.

Figure 5:
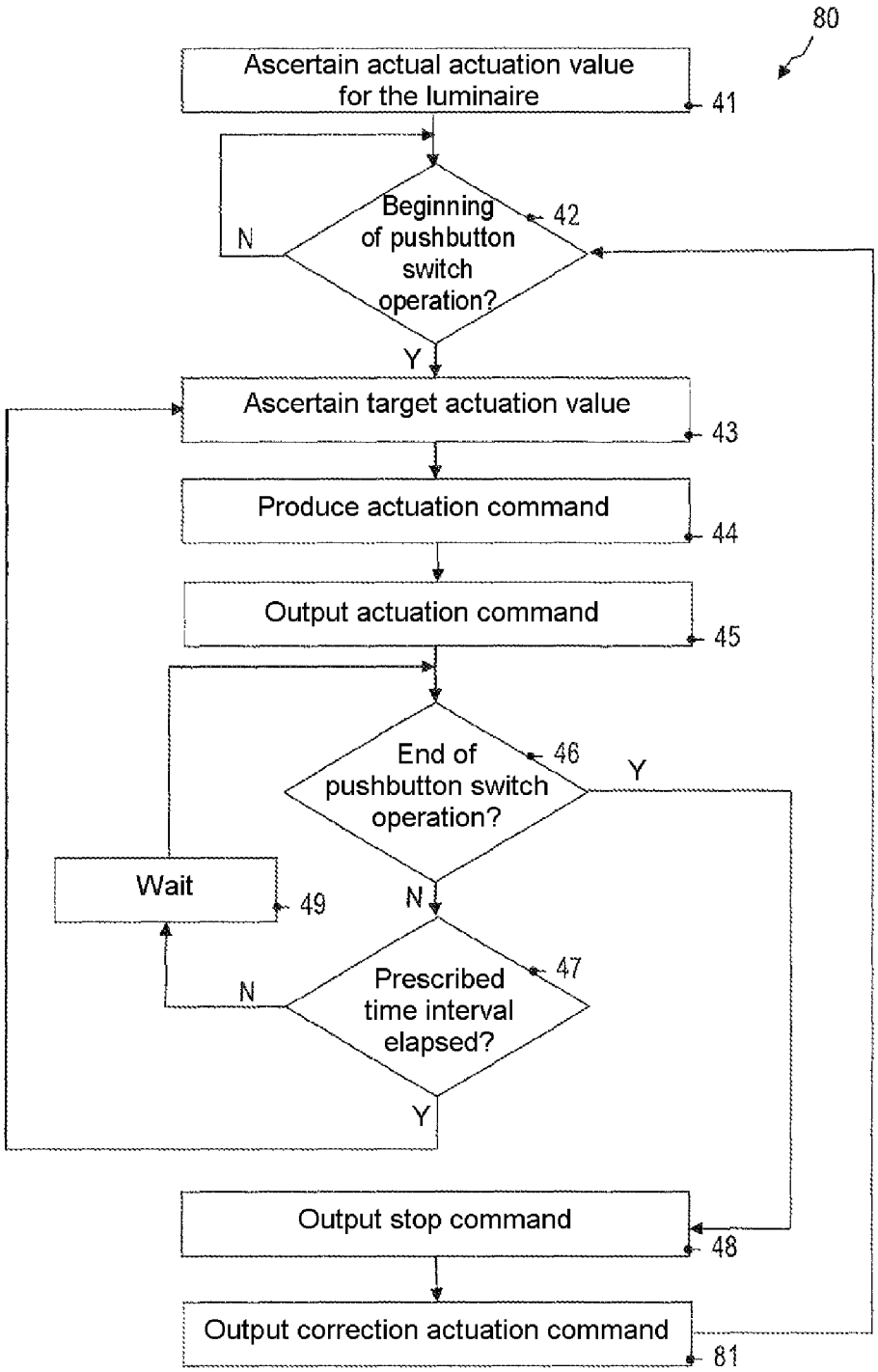
FIG. 5 shows a flowchart for a method according to a further exemplary embodiment.

FIG. 5 shows a flowchart for a method 80 according to a further exemplary embodiment. The method can be carried out automatically by the controller 10 in order to perform relative activation of a luminaire. Steps that are able to be performed as in the method 40 described with reference to FIG. 3 are denoted by the same reference symbols.

The method 80 involves a check on the pushbutton switch operation at 46, which can be used to identify an end of the operation, being repeated only quasi-continuously with a short waiting time at 49. The waiting time at 49 is short in comparison with the prescribed period of time that corresponds to the waiting time between the output of successive actuation commands.

The method 80 involves the stop command being output in response to the end of the operation of the pushbutton switch at 48. Next, at 81, a correction actuation command is output. The correction actuation command can be ascertained on the basis of an arithmetically ascertained final actuation value of the manipulated variable. By way of example, the final actuation value can be ascertained on the basis of the duration of the time interval in which the operating element is continuously operated. The final actuation value can be ascertained on the basis of the actual actuation value of the luminaire at the beginning of operation and on the basis of the duration of the time interval in which the operating element is continuously operated. The final actuation value can be ascertained as an absolute actuation value. In response to the correction actuation command that is output at 81, the operating device can set the manipulated variable to the final actuation value. The luminaire is on, and the manipulated variable of the luminaire has the final actuation value arithmetically ascertained by the controller. The correction actuation command that is output at 81 can cause absolute actuation.

In the case of methods, apparatuses and systems according to exemplary embodiments, the continuous level control from commands is replaced by activation of interpolation points with a changeover time. Adjacent interpolation points may have the same actuation value differences in relation to one another and can each be approached with the same changeover time. The actuation value changes may be either rising or falling. Such telegram-optimized activation allows a reduction in the bus utilization level that is necessary for the relative activation.

While exemplary embodiments have been described in detail with reference to the figures, modifications can be implemented in further exemplary embodiments. By way of example, the actuation command and the stop command do not need to be transmitted via a bus. The actuation commands and the stop command can be received and implemented by the luminaire directly.

While exemplary embodiments have been described in which the operating element comprises a pushbutton switch, the operating element may also have other embodiments. By way of example, the operating element that prompts the relative activation may comprise a light sensor.

While exemplary embodiments have been described in which a manipulated variable can vary linearly as a function of time, a change can also be made on the basis of other characteristic curves. By way of example, a characteristic curve that indicates the desired behavior of the luminaire for relative activation as a function of the duration of the pushbutton switch operation may be stored in the controller of the lighting system. The characteristic curve can have a nonlinear profile. By evaluating the characteristic curve, it is possible, for as long as the operation of an operating element lasts, for new target actuation values to be ascertained, the actuation value differences between successive new target actuation values being able to change.

While exemplary embodiments have been described within the context of brightness control or a dimming process, the methods, apparatuses and systems according to exemplary embodiments can also be used for other processes in which relative actuation takes place. The methods, apparatuses and systems can be used particularly whenever an actuation value change needs to be made in response to pushbutton switch operation, with the final value at the end of the process and the duration of the process not being known initially.

Methods, apparatuses and systems according to exemplary embodiments can be used for building lighting. Methods, apparatuses and systems according to exemplary embodiments can be used particularly for lighting offices or business premises, without being limited thereto. The relative actuation is in this case limited not only to luminaires as individual units but also generally to lighting systems in which individual illuminants are operated by means of an operating device in accordance with the stipulations of the relative activation. It may also cover more comprehensive lighting systems, such as facade lighting. The methods, apparatuses and systems according to exemplary embodiments relate generally to the activation of bus subscribers in a lighting system. By way of example, this relates to the activation of bus subscribers with an actuating element and with a continuous, discrete range of values.

What is claimed is:

1. A method for the relative activation of a luminaire, in which at a start of an actuation, an absolute actuation value that the luminaire is meant to adopt at the end of the actuation is not yet known, wherein operation of an operating element (3), is sensed and while the operating element (3) is being operated cyclically an actuation command (31-35; 71, 72) is issued and wherein during the operation of an operating element (3), the following steps are cyclically executed:

determining a target actuation value (P_1, P_2) that corresponds to one of a plurality of interpolation points (61, 62) that are sequentially approached during the operation, generating of the actuation command (31-35; 71, 72) on the basis of the target actuation value (P_1, P_2), and outputting the actuation command (31-35; 71, 72) in order to approach an interpolation point (61, 62) that corresponds to the target actuation value (P_1, P_2) with a prescribed changeover time (68), in which an operating device (20) of the luminaire, continuously or in multiple stages, varies the target actuation value (P_1, P_2), and wherein the actuation command (31-35; 71, 72) is sent as digital data communication via a bus (5), which has further control devices connected thereto, wherein while the operating element (3) is continuing to be operated (30) a prescribed period of time (39; 68) is waited after the output of an actuation command (31; 71) before a further actuation command (32; 72) is output in order to approach a further interpolation point (62) that corresponds to a further target actuation value (P_2).

2. The method as claimed in claim 1, wherein in response to an end of the operation of the operating element (3) a stop command (36; 74) is produced and output in order to terminate a changeover process.

3. The method as claimed in claim 2, wherein in response to the end of the operation a final actuation value is determined and a correction actuation command (75) is produced and output on the basis of the final actuation value.

4. The method as claimed in claim 2, wherein the stop command (36; 74) is output before the prescribed period of time (39; 68) after the output of that actuation command (34; 73) that was produced most recently before the end of the operation has elapsed.

5. The method as claimed in claim 1, wherein while the operating element (3) is continuing to be operated (30) a new actuation command (32-35; 71, 72) is periodically produced in each case after the prescribed changeover time (68) has elapsed.

6. The method as claimed in claim 1, wherein an input signal (51) that indicates a state of the operating element (3) is evaluated at a rate that is greater than the inverse of the prescribed period of time (39; 68).

7. The method as claimed in claim 1, wherein for the respective relative actuation process, adjacent interpolation points (61, 62) from the plurality of interpolation points (61, 62) each have the same actuation value difference (69), and wherein the prescribed changeover time (68) has a fixed value.

8. The method as claimed in claim 1, wherein at the beginning of the operation of the operating element (3) a first actuation command (31; 71) is produced that comprises the prescribed changeover time (68).

9. The method as claimed in claim 1, wherein the actuation command (31-35; 71-73) is transmitted to the operating device (20) for an illuminant (2), and wherein the operating device (20) approaches the target actuation value (P_1, P_2) continuously or in multiple stages with the prescribed changeover time (68) in response to the actuation command (31-35; 71-73).

10. A controller (10) for the relative activation of a luminaire, in which at a start of an actuation, an absolute actuation value that the luminaire is meant to adopt at the end of the actuation is not yet known, the controller (10) comprising:

a signal input (14) for receiving an input signal (51) that indicates a state of an operating element (3);

an interface (13) for outputting commands; and a control logic unit (11) that is coupled to the signal input (14) and to the interface (13) and is configured to take the input signal (51) as a basis for determining whether the operating element (3) has been operated, and in order, while the operating element (3) is being operated to generate an actuation command (31-35; 71-73), wherein the control logic unit (11) is configured, while the operating element (3) is being operated:

to determine a target actuation value (P_1, P_2) that corresponds to one of a plurality of interpolation points (61, 62), to generate the actuation command (31-35; 71-73) on the basis of the target actuation value (P_1, P_2), and to output the actuation command (31-35; 71-73) via the interface (13) as digital data communication to a bus (5) in order to approach an interpolation point (61, 62) that corresponds to the target actuation value (P_1, P_2) with a prescribed changeover time (68), in which an operating device (20) of the luminaire, continuously or in multiple stages, varies the target actuation value (P_1, P_2), wherein the control logic unit (11) is configured, while the operating element (3) is continuing to be operated (30), to wait a prescribed period of time (39; 68) after the output of the actuation command (31-35; 71, 72) before the output of a further actuation command (32-35; 72) to approach a further interpolation point (62) that corresponds to a further target actuation value (P_2).

11. A lighting system (1), comprising:

an operating element (3), a controller (10) as claimed in claim 10, the signal input (14) of which is configured to receive an input signal (51) that indicates a state of the operating element (3), and an operating device (20) for an illuminant (2), wherein the operating device (20) comprises a control device (21) configured to approach the target actuation value (P_1, P_2) with the prescribed changeover time (68) in response to the actuation command (31-35; 71-73).

12. The lighting system as claimed in claim 11, wherein the control logic unit (11) of the controller (10) is configured to produce and output a stop command (36; 74) in response to an end of the operation of the operating element (3), and wherein the control device (21) of the operating device (20) is configured to terminate an approach to an interpolation point (63) that corresponds to a target actuation value (P_3) ascertained most recently before the end of the operation in response to the stop command (36; 74).

* * * * *